US005279111A

United States Patent [19]

Bell et al.

[11] Patent Number: 5,279,111

[45] Date of Patent: Jan. 18, 1994

[54] GAS TURBINE COOLING

[75] Inventors: James A. E. Bell, Oakville, Canada; John J. deBarbadillo, Barboursville; Gaylord D. Smith, Huntington, both of W. Va.; Kirt K. Cushnie, Burlington, Canada

[73] Assignee: Inco Limited, Toronto, Canada

[21] Appl. No.: 936,115

[22] Filed: Aug. 27, 1992

[51] Int. Cl.[5] ..... F02C 3/00

[52] U.S. Cl. ..... 60/39.75; 415/115; 416/96 R; 416/241 B

[58] Field of Search ..... 60/39.75, 39.161; 415/115, 116; 416/95, 96 A, 96 R, 241 R, 241 B

[56] References Cited

U.S. PATENT DOCUMENTS

| | | | |
|---|---|---|---|
| 2,487,514 | 11/1949 | Boestad et al. | 60/41 |
| 2,618,120 | 11/1952 | Papini | 60/39 |
| 2,779,565 | 1/1957 | Bruckmann | 416/96 A |
| 3,275,294 | 9/1966 | Allen et al. | 253/39.1 |
| 3,453,825 | 7/1969 | May et al. | 60/39.161 |
| 3,584,458 | 6/1971 | Wetzler | 60/39 |
| 3,647,313 | 3/1972 | Koff | 415/115 |
| 3,782,852 | 1/1974 | Moore | 416/96 |
| 3,989,412 | 11/1976 | Mukherjee | 416/97 |
| 4,040,767 | 8/1977 | Dierberger et al. | 415/115 |
| 4,415,310 | 11/1983 | Bouiller et al. | 416/95 |
| 4,900,640 | 2/1990 | Bell et al. | 428/632 |
| 4,904,542 | 2/1990 | Mroczkowski | 416/241 B |
| 4,916,022 | 4/1990 | Solfest et al. | 416/241 B |
| 4,927,714 | 5/1990 | Priceman | 416/241 B |

FOREIGN PATENT DOCUMENTS

| | | |
|---|---|---|
| 491829 | 4/1953 | Canada . |
| 602530 | 6/1948 | United Kingdom . |

*Primary Examiner*—Richard A. Bertsch
*Assistant Examiner*—W. J. Wicker
*Attorney, Agent, or Firm*—Edward A. Steen

[57] ABSTRACT

A gas turbine having internally cooled thermal barrier coated turbine blades is disclosed. The turbine blades are made from an alloy substrate exhibiting a low coefficient of thermal expansion, an intermediate bond coating and an exterior ceramic coating. Cooling fluid is supplied from the shaft of the compressor where it flows into and out of the turbine blade. Thermal barrier coated turbine blades result in more efficient gas turbine designs.

6 Claims, 2 Drawing Sheets

GAS TURBINE COOLING

TECHNICAL FIELD

The instant invention relates to gas turbine power plants in general and more particularly to an internally cooled turbine blade and vane construction which have an outer ceramic coating.

BACKGROUND ART

In order to increase the efficiency of gas turbine power plants, both mobile and fixed, there usually must be a concomitant increase in the operating temperatures and pressures of these devices. Components made from superalloys and coated materials have allowed increased operating parameters.

By the same token, cooling air has allowed these units to operate at higher turbine inlet temperatures. Air cooling has permitted a rise in advanced turbine design inlet temperatures from 1100° C. (2012° F.) for uncooled blades to 1450° C. (2542° F.) for air cooled blades.

In some designs, the air is exhausted through many small holes in the blade, the blade root, the vane or the vane root. For the purpose of discussion, unless otherwise indicated the terms "blade" and "vane" may be used interchangeably. The cooling air, cooler than the hot expanded turbine gas, provides film cooling as well as direct internal cooling of the blade. In other designs, the cooling air is internally routed through the body of the blade. Examples of these designs may be found in U.S. Pat. Nos. 4,415,310; 3,275,294; 4,040,767; 3,909,412; 3,782,852; 3,584,458; 2,618,120; 3,647,313; and 2,487,514. Other designs are developed in Canadian patent 991,829 and U.K. patent 602,530. The aforementioned U.K. patent utilizes thermal barrier coatings and exhausts the cooling air from the trailing edge.

Current standard uncooled turbines usually operate at about 930° C. (1706° F.). Cooled blades, vanes (or stators) and discs operate in the 1316°-1450° C. (2400° F.-2642° F.) range. Cooling air is bled from the compressor and routed into and around the blades and vanes. Cooling is accomplished by film, transpirational and convective modes.

Current designs have a drawback in that the cooling air exits into a relatively high pressure gas stream. This requires the full compressor pressure to be used for the cooling air. Also, any exposed holes in the blade or root of the blade that has a thermal barrier coating can lead to premature failure of the ceramic coating. The degree of cooling of the blade is mainly a function of the mass flow rate of the cooling air that flows past it and is not particularly affected by the pressure of the air. It has been determined that the performance of the blades with thermal barrier coatings are limited by the cooling air. What is needed to push the gas turbine to higher performances is to use a thermal barrier coating on the blades and vanes and to change the internal air cooling system and integrate it with the turbine system.

U.S. Pat. No. 4,900,640, commonly assigned, discloses the concept of using a ceramic thermal barrier coating on a controlled expansion alloy with a coefficient of thermal expansion (CTE) such that it approximately matches the CTE of the overlaying ceramic. With the matched CTE's, the ceramic does not spall off the metal during thermal cycling. Use of the matched CTE's also allows a thicker ceramic with better insulating properties to be used than was previously the case with unmatched CTE's. The thicker thermal barrier coatings accompanied by new internal cooling arrangements disclosed and claimed here can lead to improved turbine performance.

SUMMARY OF THE INVENTION

Accordingly, there is provided a gas turbine power plant having internally cooled thermal barrier coated blades made from a low coefficient of expansion alloy. Cooling air from the compressor is routed through the blades.

PREFERRED MODE FOR CARRYING OUT THE INVENTION

Figure 1:
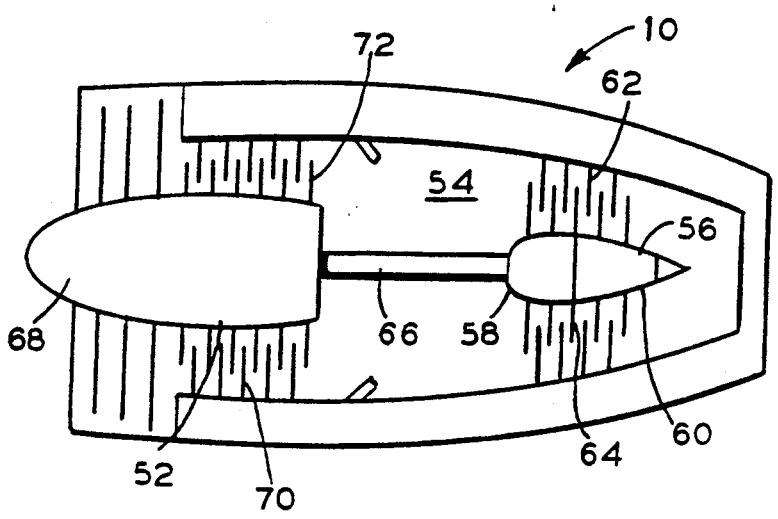
FIG. 1 is a simplified cross sectional view of a gas turbine.

FIG. 1 depicts the interior of a gas turbine 10 in simplified fashion.

Whether the turbine is used for stationary power generation or for motive power (as shown), the basic principles of modern gas turbine design and operation are well known. The gas turbine 10 essentially consists of a forward air fan 68, a compressor 52, an intermediate combustion chamber 54 and an aft turbine section 56 typically comprised of high and low pressure turbines 58 and 60. A central rotatable shaft 66 connects the compressor 52 and the turbine 56. The ducted fan 68 and the compressor 52 may or may not be connected and the low and high pressure turbines 60 and 58 may or may not be fixed to same shaft 66. In some arrangements the low pressure turbine 60 is separately connected to the ducted fan 68 and the high pressure turbine 58 is connected separately to the compressor 52. The compressor 52 and the turbine 56 consist of alternating intimate rows of fixed vanes (or stators) 62 and 70 and rotating blades 64 and 72. The blades 64 and 72 are affixed to discs (not shown) which rotate with the shaft 66. Air enters the compressor 52 where it is highly pressurized. The compressed air is directed into the combustion chamber 54 where it is burned with fuel to raise the temperature of the air and resultant combustion gases.

The heated air/gas mixture expands against the myriad turbine vanes 62 and blades 64 to rotate the turbine 56. By virtue of the shaft 66, the compressor 52 and the fan 68 are simultaneously rotated. In cooled turbines, a portion of the air from the compressor 52 is bled off to cool the various vanes and blades.

Figure 2:
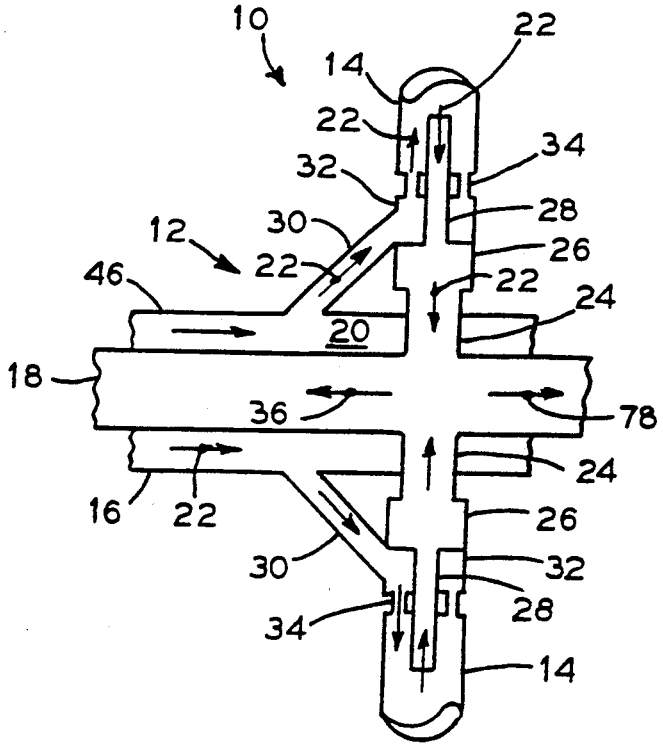
FIG. 2 is a partial cross sectional view of the invention.

FIG. 2 shows a preferred turbine section 12. A plurality of thermal barrier coated turbine blades 14 are arrayed about dual shaft 46. The shaft 46, which is connected to the compressor (not shown) includes an outer hollow shaft 16 and a concentric inner hollow shaft 18. Air bled from the compressor in the usual fashion is forced through the annulus 20 formed between the inner and outer shafts 18 and 20 as shown by directional arrows 22.

The coated blades 14 are affixed to a continuous disc-like tower 24 radially extending from the shaft 46. The tower 24 consists of an exit circular plenum 26 directly communicating with the inner shaft 18. The exit plenum 26 extends via member 28 into the blade 14.

A plurality of connectors 30 branch off from the outer shaft 16 and are affixed to an inlet circular plenum 32. Risers 34 bridge the inlet plenum 32 with the blades 14.

The air continues to flow through the connectors 30, into the inlet plenum 32 and the risers 34 until reaching the blade 14. The air then reverses direction and flows into the member 28 and then through the exit plenum 26. The air may be rerouted back towards the compressor through the inner shaft 18 (arrow 36) and/or out the exhaust (arrow 78).

For modern bypass turbine engines an additional coaxial shaft (not shown) may be used to accommodate the high and low pressure turbine sections and their ultimate connections to the compressor and ducted fan sections.

Figure 3:
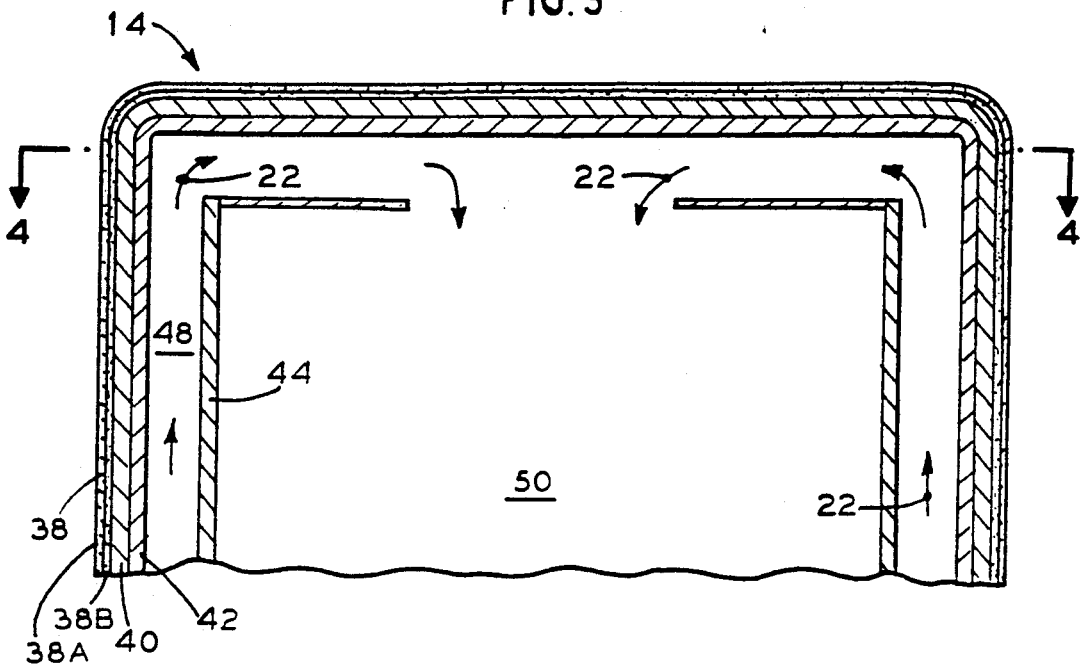
FIG. 3 is a detailed view of an embodiment of the invention.
Figure 4:
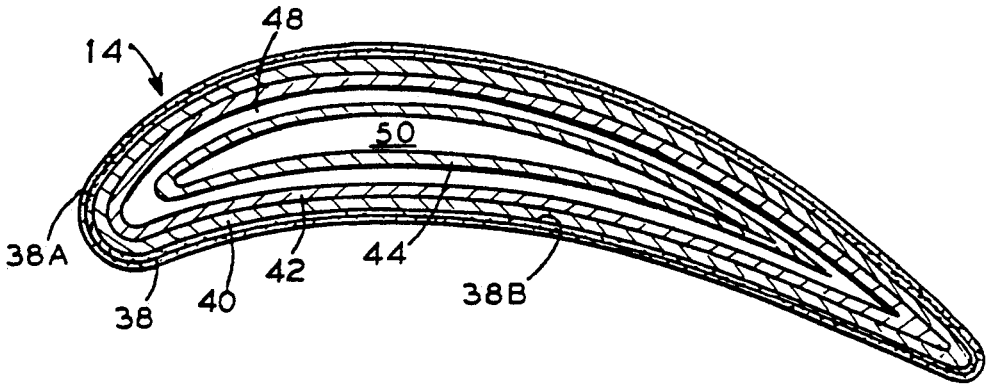
FIG. 4 is a view taken along line 4—4 in FIG. 3.

The blade 14 is shown in greater detail in FIGS. 3 and 4. As is discussed in U.S. Pat. No. 4,900,640 which is incorporated herein by reference, blade 14 is made from a low coefficient of expansion alloy 40, such as INCOLOY® alloy 909, having a thermal barrier coating 38 comprising a oxidation resistant intermediate bond coating 38B, such as ZA1 (Z being 1 to 5 elements selected from the group consisting of Ni, Fe, Co, Cr and Y), and an outer insulative ceramic layer 38A such as partially stabilized 8% yttria-zirconia (8YZ).

Alloy 909 is a 900 series iron-nickel based controlled coefficient of thermal expansion alloy including about 38% nickel, about 13% cobalt, about 4.7% niobium, about 1.5% titanium and about 45% iron. This particular alloy has a low linear coefficient of expansion of about 10 micrometers/m/° C. at about 649° C. which roughly matches the linear coefficient of expansion of the ceramic coating—8% $Y_2O_3$—$ZrO_2$. Other controlled coefficient of expansion alloys existing or contemplated may be substituted as well.

The controlled coefficient of expansion alloy 40 is attached to a superalloy inner skin 42 such as INCONEL® alloy 718. Diffusion bonding between the alloy 40 and the skin 42 is the preferred mode of attachment. This inner skin 42 prevents oxidation of the inner surface of the alloy 909 during high temperature service.

An optional alternative construction involves placing a thin coating of an oxidation resistant alloy such as alloy 718 between the bond coat and outer surface of the alloy 909 as well as on the inner surface of the alloy 909. This provides extra oxidation protection for the alloy 909. Of course, the thickness of the alloy 718 must be thin with regard to the alloy 909 so as to not effect the combined coefficient of thermal expansion of the 718/909/718 alloy sandwich construction.

A hollow internal airfoil 44 is disposed within the blade 14 forming an inlet internal cooling chamber 48 and an outlet internal cooling chamber 50 therewith. The inlet circular plenum 32, the risers 34 and the inlet internal cooling chamber 48 are all interconnected to provide cooling air to the blade 14. The cooling air 22 travels through the chamber 48 and then is rerouted through the outlet internal cooling chamber 50, the member 28 and the exit circular plenum 26.

The outer coating 38 has low thermal conductivity and a coefficient of expansion acceptably compatible with the underlying alloy substrate 40. The insulated blade 14 is capable of operating in higher temperature gas streams than uncoated blades. The blade is affixed to the tower 28 by conventional means such as welding and/or mechanical connection.

The testing of thermal barrier coatings in cyclic temperature service is documented by U.S. Pat. No. 4,900,640. The results revealed in this patent demonstrated the superior spall resistance of thermal barrier coated pins when the CTE of the ceramic thermal barrier coating and the substrate metal were similar. However, these results could not show the benefit of a thermal barrier coating for turbine applications because the cyclic furnace employed had no hot side gas flow. Hence, a burner rig was constructed.

The burner rig used a natural gas/air burner which fires into a 50.8 mm (2 inches) inner diameter, 508 mm (20 inches) long alumina fiber cylinder. Test pins were positioned at a right angle to the cylinder axis through the cylinder diameter 330 mm (13 inches) from the burner.

Test pins were fabricated from the controlled expansion alloy 909. They were machined to 76 mm (3.0 inches) long, 15.88 mm (0.63 inches) outside diameter and 6.53 mm (0.26 inches) inner diameter, with rounded shoulders. A 2.1 mm (0.083 inches) diameter hole, 40 mm (1.6 inches) deep was drilled through the center of the metal annulus for placement of a thermocouple. These pins were slipped over an inner metal tube of INCONEL® alloy 600 (outside diameter 6.35 mm [0.25 inches] inside diameter 4.57 mm [0.18 inches]). Cooling air was passed through this inner tube during testing. The tube is required to protect the alloy 909 substrate which has poor oxidation resistance. The pin and tube arrangement is then plasma sprayed with the desired coating.

A typical plasma coating consists of a 180 micrometer thick NiCrAlY (22 wt % Cr, 10 wt % Al, 1 wt % Y, bal. Ni) intermediate bond coat covered with a 500 to 1000 micrometer thick coating of 8 wt % yttria—zirconia (8YZ) insulative ceramic layer. The intermediate bond coat is required to provide oxidation protection to the alloy 909 substrate and to provide a rough surface for mechanical bonding of the 8YZ layer. Depending on the 8YZ coating thickness, the pin occupies between 40% and 45% of the burner rig cross-sectional area.

Selected burner rig test results are given in Table 1. The burner temperatures were measured with an unsheathed type R thermocouple located approximately 25 mm (0.9 inches) in front of the pin, 13 mm (0.5 inches) into the hot gas steam above the pin. The burner velocity is a calculated value for the velocity past the pin (i.e. cross-sectional area not occupied by pin). Assumptions made in the calculations are that complete combustion occurs, the pressure is 1 atm and the gases behave ideally. The metal temperature is measured with a type K thermocouple inserted into the previously mentioned hole in the substrate. The pin is oriented such that the metal thermocouple is located in the center of the hot gas stream facing the burner. The cooling air flow $\Delta T$ is the difference between the cooling air temperature entering the pin (22° C. to 25° C. [71°-77° F.]) and that leaving, as measured by type K thermocouples inserted into the gas stream. The heat transfer is calculated from the measured $\Delta T$ and cooling air flow rate, using thermodynamic properties of air at the mean temperature.

A mathematical model was prepared to calculate the steady-state temperature distribution across a composite cylinder consisting of an alloy 909 tube covered with a NiCrAlY bond coat and an 8YZ ceramic layer. Heat enters the system by radiation and convection. The emissivity and absorbtivity of the coating are a function of temperature. The exterior convective heat transfer was calculated using an average heat transfer coefficient for flow across a single cylinder. All heat is removed from the inside of the tube by convection, using a calculated convective heat transfer coefficient. These values and equations can be found in standard heat transfer textbooks.

The thermal conductivity of the 8YZ ceramic layer is assumed to be 0.80 W/mK while the conductivity of the NiCrAlY bond coat is assumed to be 7.0 W/mK. These are published approximate average values. The conductivity of INCOLOY alloy 909 as a function of temperature can be found in publications published by the manufacturer INCO ALLOYS INTERNATIONAL, INC., of Huntington, W. Va., U.S.A.

TABLE 1

| | A | B | C | D | E |
|---|---|---|---|---|---|
| Burner (°C.) | 1398 | 1400 | 1609 | 1607 | 1604 |
| Thermal Barrier | Yes | No | Yes | Yes | Yes |
| Ceramic Coating thickness (micrometers) | 1150 | 0 | 1150 | 1150 | 540 |
| Burner velocity (m/s) | 36.9 | 37.0 | 40.0 | 72.2 | 70.2 |
| Cooling airflow (slpm) | 200 | 200 | 200 | 200 | 350 |
| Metal temperature (°C.) | 687 | 878 | 856 | 894 | 999 |
| Cooling airflow (ΔT) | 160 | 121 | 142 | 175 | 106 |
| Heat Transfer (watts) | 465 | 535 | 626 | 676 | 811 |

The benefit of the ceramic thermal barrier coating is illustrated by comparing tests A and B in Table 1. In test B the ceramic coating was ground off the metal but conditions were otherwise unchanged. The metal temperature rose by 191° C. (376° F.) when no ceramic was present. Comparison of tests C and D reveals that increasing burner velocity from 40 m/s (131 ft/sec) to 72.2 m/s (237 ft/sec) has minimal effect on metal temperature when the metal is coated with the thermal barrier coating. The important effect of coating thickness can be seen by comparing D and E. However, direct comparison is complicated by the fact that the numbers were obtained on two different pins. These numbers are affected by any differences between the respective alloy 600 cooling tube/alloy 909 substrate interfaces. In practice a diffusion bond would be made and no impediment to heat flow would occur at this interface. Calculations indicate that for the geometry and conditions tested, the presence of the cooling tube/substrate interface results in a metal temperature −100° C. (212° F.) higher than if no interface was present.

One can calculate what the steady-state temperatures would be in an economical application for thermal barrier coatings in a gas turbine engine. Such calculations show that less than 1% of the air from the compressor section would be required for cooling one stage of blades to keep the temperature of the alloy 909 under 850° C. (1562° F.) when operating in a gas turbine with a turbine inlet gas stream at 1600° C. (2912° F.) and 40 atm pressure, with a relative gas velocity of 500 m/s (1651 ft/sec).

However a new routing of cooling air may be employed for thermal barrier coated blades. A number of possible routings are explored in Table 2. In all cases the compressor efficiency was taken as 87% and the turbine efficiency as 85%. A nominal 10% of the compressor gas was used for cooling the blades, vanes and shrouds etc. in all cases.

TABLE 2

| Example | Cooling air routing | With Thermal Barrier Coating | Compressor pressure rise (atm) | Cooling air pressure (atm) | Turbine Inlet Temp. (°C.) | Turbine Effic. % | Net Work Joules/kg mole × $10^7$ (BTU/lb mole) air |
|---|---|---|---|---|---|---|---|
| 1 | Through blade, exit to hot gas | No | 15 | 15 | 1450 | 40.4 | 1.62 (6981) |
| 2 | Through blade, exit at base of blade | Yes | 15 | 15 | 1600 | 42.2 | 1.97 (8489) |
| 3 | Through blade, exit end of shaft | Yes | 15 | 6 | 1600 | 44.3 | 2.07 (8914) |
| 4 | Through blade, to compressor inlet via shaft T rise = 330° C. | Yes | 15 | 6 | 1600 | 45.5 | 2.00 (8620) |
| 5 | Through blade, to compressor inlet via shaft T rise = 166° C. | Yes | 20 | 8 | 1600 | 47.5 | 1.98 (8538) |
| 6 | Through blade, to compressor inlet via shaft T rise = 166° C. | Yes | 15 | 6 | 1600 | 44.9 | 2.04 (8768) |

A thermal barrier coating will allow the turbine inlet temperature to increase from 1450° C. (2692° F.) to 1600° C. (2912° F.). As seen in comparing example 2 to example 1, this will result in a 1.8% improvement in thermal efficiency and more importantly an increase in the net work from $1.62\times10^7$ to $1.92\times10^7$ joules/kg mole (6981 to 8489 BTU/lb mole) of air passing through the turbine (21.6% increase). The maximum thrust of the engine is directly proportional to the net work. As was noted earlier, in conventional designs cooling air goes through the shaft and exits through holes in the blade so as to provide film cooling for the metal blade.

With the thermal barrier coating 38 the cooling air can be directed back to the inner shaft 18 and a considerably lower pressure drop will be required if a suitable low pressure drop passageway is used. The cooling air in this case merely exits (directional arrow 38) to ambient out the turbine shaft 14. In this case, (example 3 versus example 2) the efficiency of the turbine will rise from 42.2 to 44.3% and the net work per mass mole of air through the turbine will rise from $1.97\times10^7$ to $2.07\times10^7$ joules/kg mole (8489 to 8914 BTU/lb mole) or a further 5% increase.

If an arrangement is constructed to duct the exhaust cooling air back to the central portion of the shaft 18, it can be directed back to the compressor inlet (directional arrow 36). This will cause an improvement in the efficiency of the turbine whose magnitude depends on the temperature rise of the cooling air through the blade. For a 333° C. (631° F.) temperature rise of the cooling air through the blade, ducting the cooling air back to the compressor increased the efficiency from 44.3 to 45.5% but lowered the net work per mass mole of air from $2.07\times10^7$ to $2.0\times10^7$ joules/kg mole (8914 to 8620 BTU/lb mole) (example 4 versus example 3). If the temperature rise was closer to the 166° C. (331° F.) expected, the efficiency would be 44.9% and the net work per mass mole of air would be $2.04\times10^7$ joules/kg mole (8768 BTU/lb mole) as shown in example 6.

All of the values in Table 2 (except 5) were calculated at 15 atmopheres pressure rise, because this pressure rise results in the maximum value for the net work per mass mole of air through the turbine (i.e., maximum thrust). One always has the option of not working at the optimum pressure rise for maximum thrust as shown in example 5. By increasing the pressure rise in the compressor the efficiency can increase to 47.5% but the network per mass mole of air will decrease to $1.98\times10^7$ joules/kg mole (8538 BTU/lb mole).

Usually there are two turbines in a motive thrust gas turbine, one attached directly to the compressor and the other to the power drive or fan. While the turbine attached to the compressor is usually the hottest, the power turbine or fan vanes and blades can also have a thermal barrier coating and can be cooled. The low pressure air can be routed through the power turbine blades by purging air down the power shaft through the blades and back through the central compartment in the power shaft.

In summary, it has been shown that using a thermal barrier coating on alloy 909 permits turbine inlet temperatures of 1600° C. (2912° F.) to be used without damage to the blade. The design of the turbine should be changed to optimize the benefit of the thermal barrier coating. The cooling air passage through the shaft to the blade and exit from the blade back through a central portion of the shaft designed with the lowest pressure drop possible can give an improvement in efficiency which is just as large as the efficiency improvement resulting from the increase in turbine operating temperature. Designs are also possible which will allow the exhausted cooling air in the central portion of the shaft to be ducted either to the turbine exhaust or back to the compressor. This would allow the turbine to be controlled in flight for maximum thrust or maximum efficiency as desired.

While in accordance with the provisions of the statute, there are illustrated and described herein specific embodiments of the invention, those skilled in the art will understand that changes may be made in the form of the invention covered by the claims and that certain features of the invention may sometimes be used to advantage without a corresponding use of the other features.

The embodiments of the invention in which an exclusive property or privilege is claimed are defined as follows:

1. An improved gas turbine engine, the turbine engine including a fluid compressor, a turbine section, a combustion section disposed therebetween, a rotatable shaft connecting the compressor and the turbine section, and means for diverting a portion of the fluid from the compressor through the shaft towards the turbine section, the improvement comprising internally cooled thermal barrier coated turbine blades made from a controlled coefficient of expansion alloy connected to the shaft, towers radially extending from the shaft, the shaft including an inner concentric shaft and an outer shaft, the blades affixed to the towers, the towers including an exit plenum and an inlet plenum, the inlet plenum circumscribing the outlet plenum, the exit plenum communicating with the inner concentric shaft, the inlet plenum communicating with the outer shaft via a connector, a source of cooling fluid communicating with the outer shaft, and a cooling fluid path from the outer shaft enveloping the exit plenum and exiting the exit plenum into the inner concentric shaft.

2. The turbine engine according to claim 1 wherein the turbine blade includes an external coating having a ceramic layer, an intermediate bond coating and a controlled expansion alloy substrate, and the alloy and the ceramic layer having similar coefficients of thermal expansion.

3. The turbine engine according to claim 2 wherein the substrate is attached to a superalloy skin.

4. The turbine engine according to claim 2 wherein the turbine blade includes an internal hollow airfoil disposed therein.

5. A turbine blade comprising an external surface including a controlled coefficient of expansion iron-nickel containing alloy substrate, an intermediate bond coating including ZA1 wherein Z is selected from the group consisting of Ni, Fe, Co, Cr, Y and mixtures thereof, a ceramic outer coating including yttria and zirconia, the coefficient of thermal expansion of the alloy substrate approximating the coefficient of thermal expansion of the ceramic outer coating, an oxidation resistant alloy affixed to the alloy substrate, an airfoil disposed within the turbine blade, an inlet cooling chamber disposed between the airfoil and the external surface, and a cooling fluid path first entering the inlet cooling chamber and then leaving through an outlet cooling chamber disposed within the airfoil.

6. The turbine blade according to claim 5 connected to a dual shaft including a first shaft and a second shaft, the inlet cooling chamber communicating with the first shaft and the outlet cooling chamber communicating with the second shaft, and a cooling fluid path first routed through the first shaft and inlet cooling chamber and then exiting the outlet chamber and into the second shaft.

* * * * *